United States Patent [19]

Osaki

[11] 4,443,924

[45] Apr. 24, 1984

[54] METHOD OF AND APPARATUS FOR DETECTING ENDS OF SUCCESSIVE FLY STRIPS CONNECTED BY A SLIDE FASTENER CHAIN

[75] Inventor: Tatsuo Osaki, Uozu, Japan

[73] Assignee: Yoshida Kogyo K. K., Tokyo, Japan

[21] Appl. No.: 391,940

[22] Filed: Jun. 24, 1982

[30] Foreign Application Priority Data

Jun. 30, 1981 [JP] Japan ..... 56-100550
Sep. 9, 1981 [JP] Japan ..... 56-140885

[51] Int. Cl.[3] ..... B21D 53/50; B21D 53/52; A41H 37/06

[52] U.S. Cl. ..... 29/408; 29/410; 29/767; 29/770

[58] Field of Search ..... 29/408, 410, 767, 770, 29/33.2

[56] References Cited

U.S. PATENT DOCUMENTS

| | | | |
|---|---|---|---|
| 2,885,774 | 5/1959 | Waldes | 29/408 |
| 3,570,104 | 3/1971 | Jensen | 29/403 |
| 3,630,969 | 2/1972 | Potin | 29/408 |
| 3,863,323 | 2/1975 | Takamatsu | 29/408 |
| 4,333,232 | 6/1982 | Orr et al. | 29/770 |

*Primary Examiner*—Howard N. Goldberg
*Assistant Examiner*—Steven Nichols
*Attorney, Agent, or Firm*—Hill, Van Santen, Steadman & Simpson

[57] ABSTRACT

A method of and apparatus for detecting ends of successive fly strips connected end to end by a slide fastener chain. The successive fly strips, with their first flaps superimposed on a tape of one fastener stringer and with their second flaps superimposed on the other fastener stringer, are fed along a first straight path. The successive second flaps are deflected or moved aside, as they pass a wedge-shaped plow on the first straight path, to such an extent that the individual second flap lies at a right angle with respect to the general plane of the fastener stringers. Then, the direction of movement of the successive fly strips is shifted at a turning point to a second straight path inclined with respect to the first straight path so as to provide temporarily a relatively large triangular space between an adjacent pair of the deflected second flaps when the same confronting ends arrive at the turning point. Finally, a detector senses the presence of the triangular space, which indicates the arrival of confronting ends of an adjacent pair of the fly strips.

5 Claims, 28 Drawing Figures

METHOD OF AND APPARATUS FOR DETECTING ENDS OF SUCCESSIVE FLY STRIPS CONNECTED BY A SLIDE FASTENER CHAIN

BACKGROUND OF THE INVENTION

1. Field of the Invention

The present invention relates automation of the manufacture of trouser closures for fly openings, and more particularly to a method of and apparatus for detecting ends of a succession of fly strips connected end to end by a slide fastener chain.

2. Prior Art

In the manufacture of trouser closures for fly openings, a slide fastener chain, to which a succession of fly strips is attached, is fed to an intermittently operating apparatus for forming element-free gaps in the fastener chain. To this end, it has been the common practice to detect ends of the successive fly strips in order to automatically control the intermittent operation of the element-free gap forming apparatus; confronting ends of an adjacent pair of the fly strips are sensed by a feeler or other mechanical means. However, the successive fly strips are connected end to end in substantially abutting relation with only a very small space between an adjacent pair of the fly strips. With this smallness of the inter-fly spaces, accurate detection of the fly ends is difficult to achieve. U.S. Pat. No. 3,570,104, issued Mar. 16, 1971 to P. B. Jensen, is believed to exemplify the prior art.

SUMMARY OF THE INVENTION

It is an object of the present invention to provide a method for detecting ends of successive fly strips connected end to end in substantially abutting relation by a slide fastener chain, and to do so accurately with maximum ease.

Another object of the invention is to provide an apparatus for carrying out the above-mentioned method, which is very simple in construction and hence inexpensive.

According to the present invention, a succession of fly strips connected end to end in substantially abutting relation by a slide fastener stringer chain is provided as a starting material. The successive fly strips, with their first flaps underlapping the tape of one fastner stringer and with their second flaps underlapping the other fastener stringer, are fed along a first straight path. The second flaps are deflected or moved aside, as they pass a wedge-shaped plow on the first straight path, to such an extent that the individual second flap lies at a right angle with respect to the general plane of the fastener stringers. Then, the direction of movement of the successive fly strips is shifted at a turning point to a second straight path inclined with respect to the first straight path so as to provide temporarily a relatively large triangular space between confronting ends of an adjacent pair of the deflected second flaps with the same confronting ends arrive at the turning point. Finally, a detector senses the presence of the triangular space, which indicates the arrival of confronting ends of an adjacent pair of the fly strips.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 1:
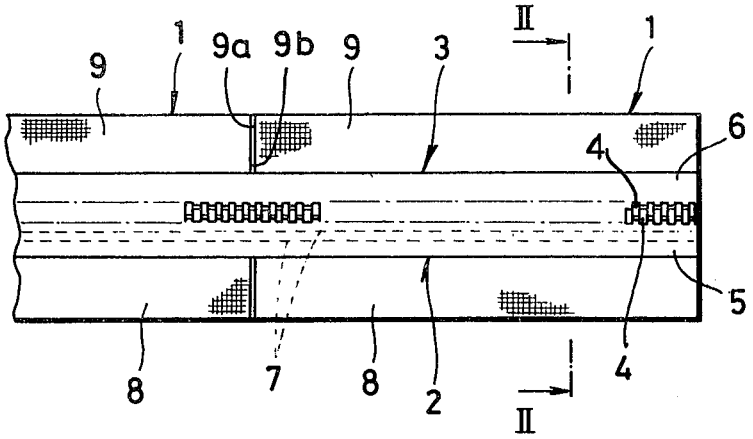
FIG. 1 is a fragmentary plan view of a slide fastener chain in which a series of fly strips is attached.

FIG. 1 shows a succession of fly strips 1 connected end to end in substantially abutting relation by a pair of continuous fastener stringers 2,3 having a pair of interengaged rows of coupling elements 4,4 mounted on a pair of tapes 5,6 along their confronting longitudinal edges. The successive fly strips 1 are attached to the tape 5 of one fastener stringer 2 by at least one line of stitching 7 dividing each fly strip 1 into a first and a second flap 8,9. As better shown in FIG. 2, the first flap 8 underlaps only the tape 5 in close relation therewith, while the second flap 9 underlaps not only the other type 6 but also the pair of interengaged coupling element rows 4,4, with a relatively small gap 10 between the second flap 9 and the other fastener stringer 3.

Figure 3:
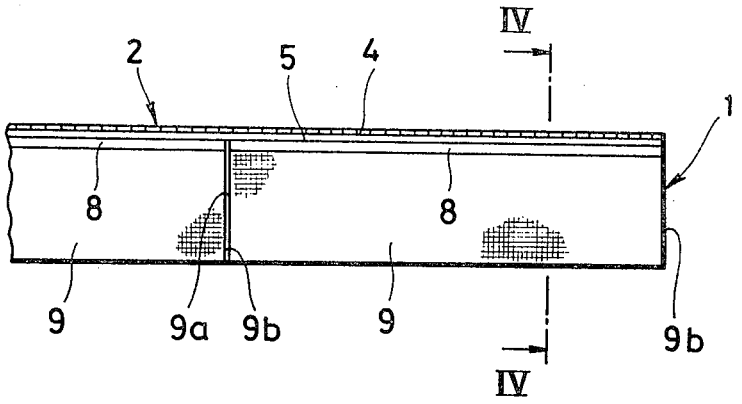
FIG. 3 is a fragmentary side elevational view of the slide fastener chain, showing second flaps of the fly strips having been deflected.
Figure 4:
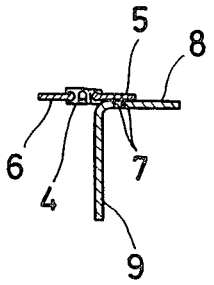
FIG. 4 is a transverse cross-sectional view taken along line IV—IV of FIG. 3.
Figure 5:
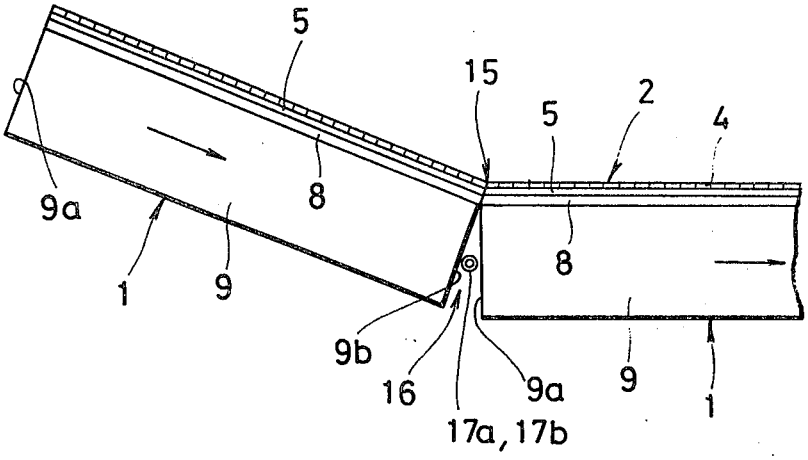
FIG. 5 is a fragmentary side elevational view of the side fastener chain, showing an adjacent pair of the second flaps with a triangular space provided between their confronting ends.
Figure 6:
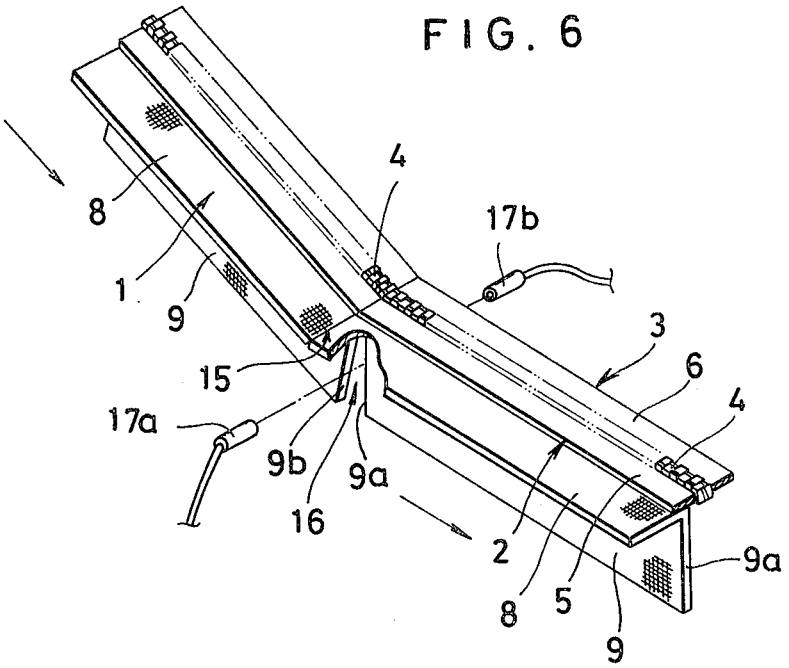
FIG. 6 is a fragmentary perspective view corresponding to FIG. 5.
Figure 7:
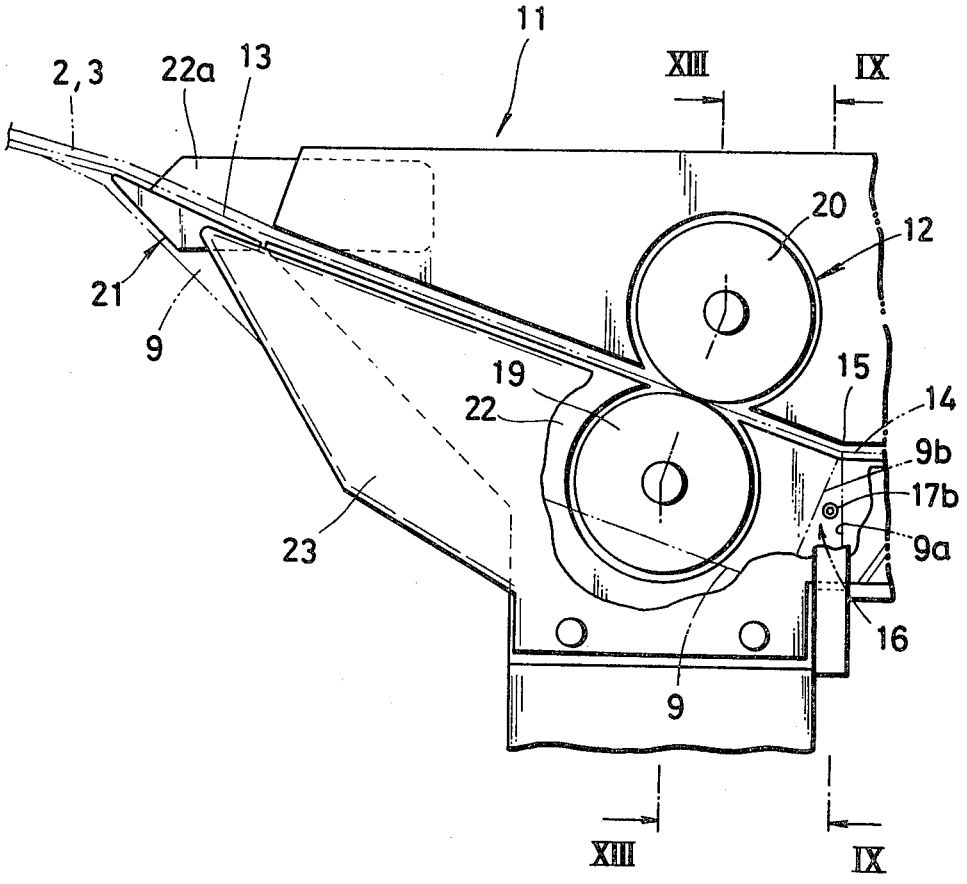
FIG. 7 is a fragmentary side elevational view of an apparatus according to the present invention, with parts broken away.

FIG. 7 shows an apparatus 11 for detecting ends of the successive fly strips 1. The apparatus 11 comprises a drive unit 12 for feeding the successive fly strips 1 along a doglegged combined path including a pair of first and second straight paths 13,14 joined at a turning point 15. The apparatus 11 also comprises a deflector (described below) disposed on the first straight path 13 upstream of the turning point 15 for moving aside or deflecting the successive second flaps 9 one at a time to such an extent that the individual second flap 9 lies at a right angle to the general plane of the fastener stringers 2,3, as shown in FIGS. 3 and 4.

The first and second straight paths 13,14 are inclined with respect to one another so that the direction of movement of the successive fly strips 1 is shifted at the turning point 15 so as to provide temporarily a triangular space 16 between confronting ends **9*a*,9*b* of an adjacent pair of the deflected second flaps 9,9 when the confronting ends 9*a*,9*b* arrive at the turning point 15**.

As shown in FIGS. 5, 6, 7 and 9, a detector 17 (FIG. 9) is disposed adjacent to the turning point 15 for sensing the presence of a triangular space 16 between an adjacent pair of the second flaps 9,9. The detector 17 includes a light source **17*a* positioned on one side of the path of the second flaps 9, and a photoelectric transducer element 17*b* positioned on the other side of the path of the second flaps 9 for receiving the light passed through the triangular space 16. The photoelectric transducer element 17*b* produces a signal pulse every time each triangular space 16 is sensed by the detector 17. Thus the signal pulse indicates that the confronting ends 9*a*,9*b* of an adjacent pair of the second flaps 9,9, i.e. a trailing end of the corresponding preceding fly strip 1 and a leading end of the corresponding succeeding fly strip 1, have arrived at the turning point 15**.

Alternatively, the detector 17 may include a jet nozzle for emitting pressurized fluid, and a pressure-sensitive element for receiving the pressurized fluid transmitted through the triangular space 16, the fluid comprising preferably air.

Figure 8:
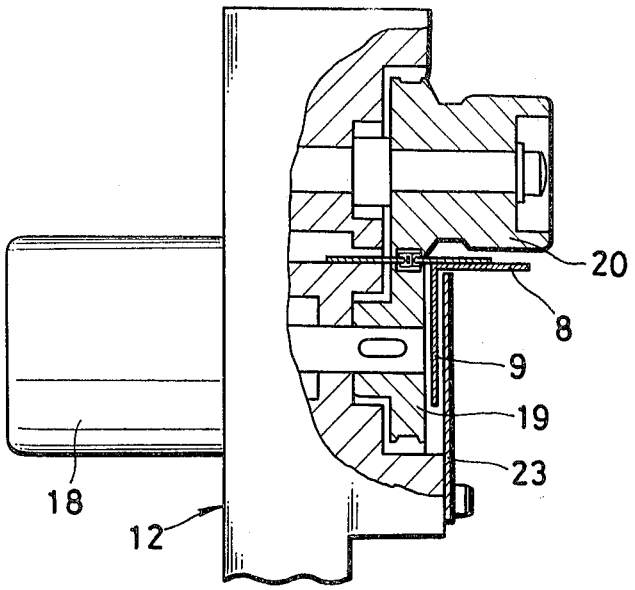
FIG. 8 is an elevational view of a drive unit, partly in cross section taken along line VIII—VIII of FIG. 7.
Figure 9:
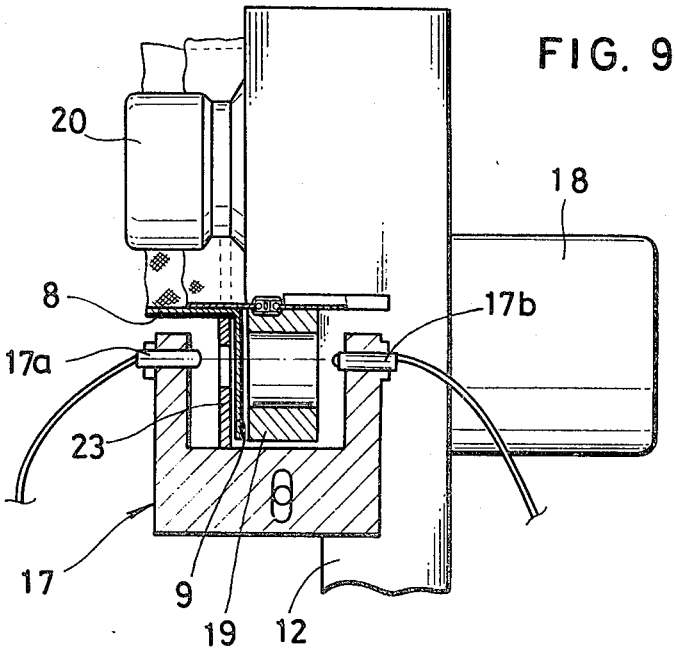
FIG. 9 is a cross-sectional view taken along line IX—IX of FIG. 7.
Figure 10:
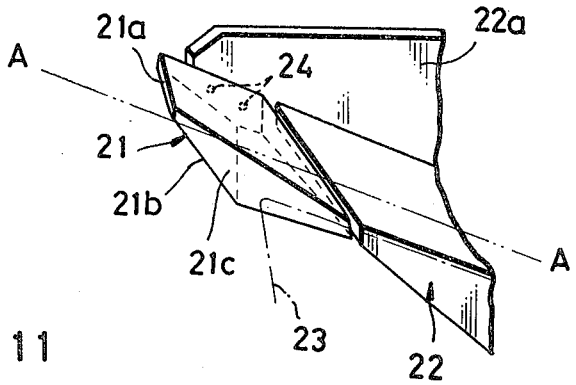
FIG. 10 is an enlarged, fragmentary perspective view of a deflector.
Figure 11:
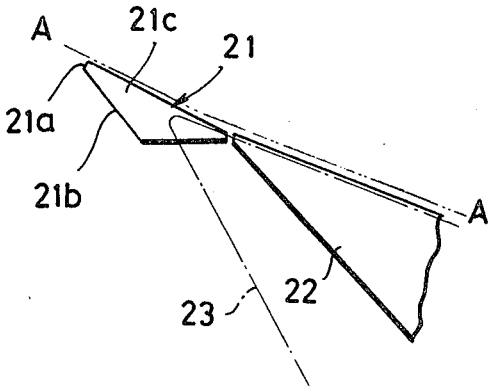
FIG. 11 is a fragmentary side elevational view corresponding to FIG. 10.
Figure 12:
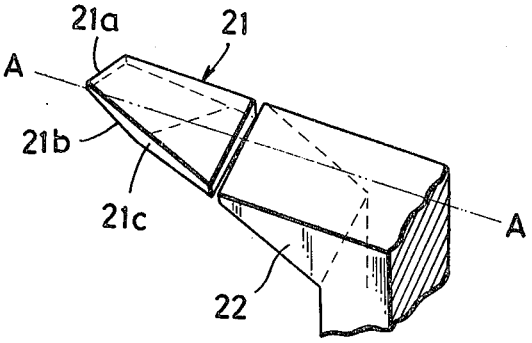
FIG. 12 is a fragmentary perspective view similar to FIG. 10, but showing the deflector as viewed from a different station point.
Figure 13:
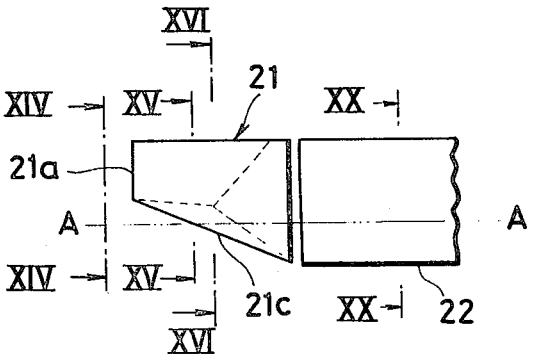
FIG. 13 is a fragmentary plan view corresponding to FIG. 10.
Figure 14:
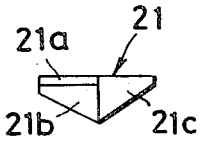
FIG. 14 is an elevational view of the deflector, as viewed along line XIV—XIV of FIG. 13.
Figure 15:
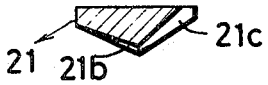
FIG. 15 is a transverse cross-sectional view taken along line XV—XV of FIG. 13.
Figure 16:
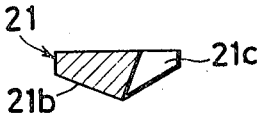
FIG. 16 is a transverse cross-sectional view taken along line XVI—XVI of FIG. 13.

The drive unit 12 (FIG. 8) includes a pair of feed rollers 19,20, one of which is a driven roller 19 to which a counter 18 is operatively connected for counting the number of revolutions of the driven roller 19. Upon receipt of a signal pulse from the detector 17, the counter 18 starts to count the number of revolutions of the driven roller 19 until the next signal pulse from the detector 17 is issued, thereby measuring the length of the individual fly strip 1. The counter 18 produces an output signal for automatically controlling an intermittently operating peripheral apparatus, such as an element-free gap forming apparatus (not shown) to which the second straight path 14 leads, depending on the length of each individual fly strip 1. At the same time, the output signal is applied to the drive unit 12 to control the feeding of the successive fly strips 1 in timed relation with the intermittent operation of such peripheral apparatus.

Figure 2:
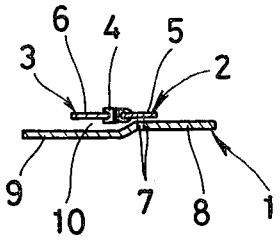
FIG. 2 is a transverse cross-sectional view taken along line II—II of FIG. 1.

As shown in FIGS. 7, 10–13 and 21, the deflector comprises a wedge-shaped plow 21 on the first straight path 13 remotely from the turning point 15 for moving aside the successive second flaps 9 one at a time, as the successive fly strips 1 pass the plow 21, from the position of FIGS. 1 and 2 to the position of FIGS. 3 and 4.

A guide 22 is disposed immediately downstream of the plow 21 and extends beyond the turning point 15 for guiding the successive fly strips 1 with the second flaps 9 in vertical or deflected position (FIGS. 3, 4, 20 and 21). The wedge-shaped plow 21 is fixed to a side plate **22*a* (FIGS. 7 and 10) of the guide 22 by means of a pair of screws 24,24**.

Figure 17:
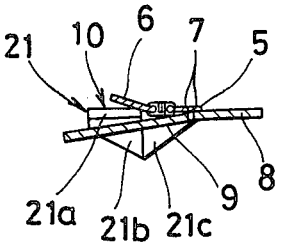
FIGS. 17, 18 and 19 are views corresponding to FIGS. 14, 15 and 16, respectively, showing the manner in which the second flap is deflected by the deflector.
Figure 19:
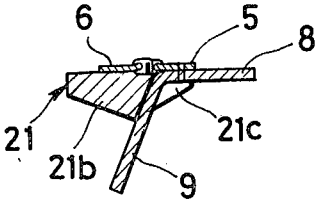
Figure 18:
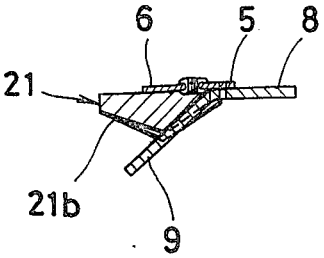

The wedge-shaped plow 21 has a transverse leading edge **21*a*, a sloping bottom surface 21*b*, and a canted side surface 21*c* extending obliquely with respect to the first straight path 13. The leading edge 21*a* is thin enough to enter between the tape 3 of the other fastener stringer 6 and the individual second flap 9 as the leading end 9*b* of the latter arrives at the plow 21, as shown in FIG. 17. With continued movement of the fly strips 1, the individual second flap 9 is moved aside progressively, as it slides on the canted side surface 21*c* as shown in FIGS. 18 and 19. In FIGS. 10–13, a dash-and-two-dot line A—A represents the longitudinal center line of the fastener stringers 2,3, i.e. the axis of the pair of coupling element rows 4. The leading edge 21*a* is disposed at the other-fastener-stringer side of the line A—A, as better shown in FIG. 13**.

Figure 20:
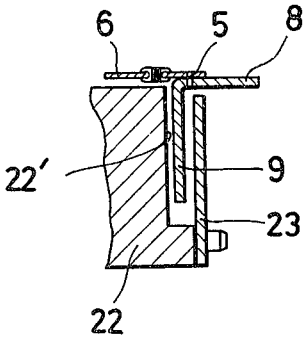
FIG. 20 is a transverse cross-sectional view taken along line XX—XX of FIG. 13, showing the second flap having been completely deflected.
Figure 21:
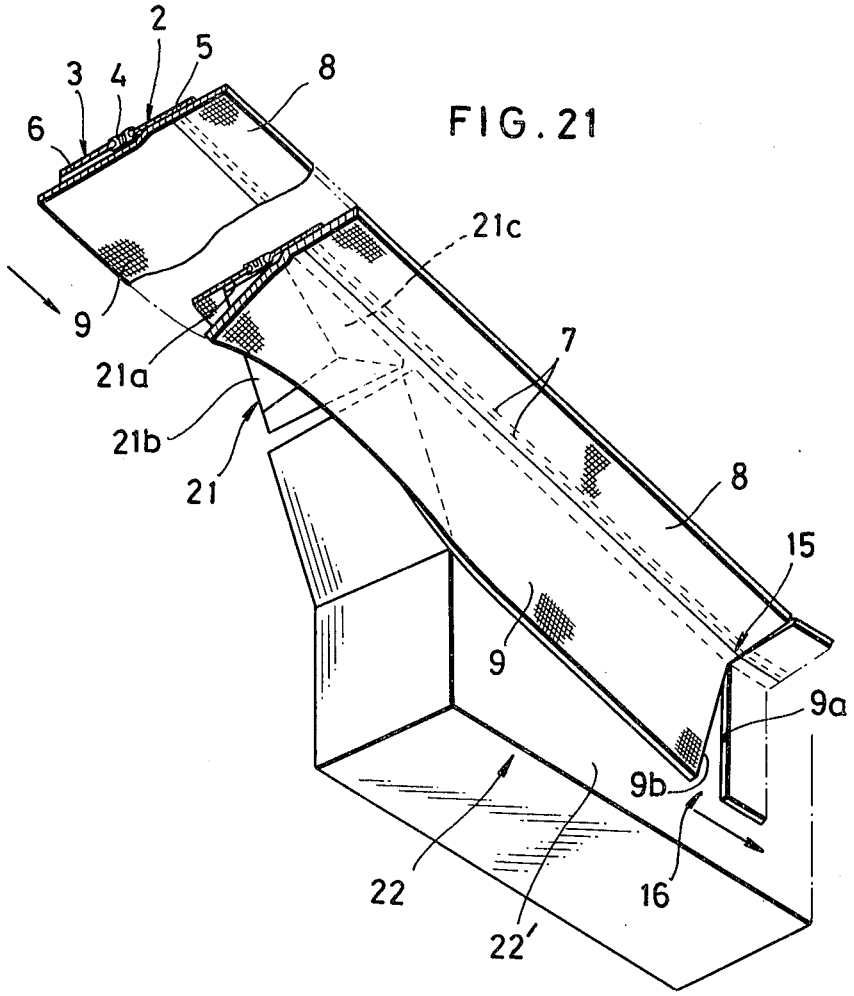
FIG. 21 is a fragmentary perspective view of the apparatus, showing the manner in which the second flap is deflected by the deflector.

In operation, the succession of fly strips 1, with the first flap 8 underlapping the tape 5 of one fastener stringer 2 and with the second flap 9 underlapping the other fastener stringer 3, are fed along the first straight path 13 (FIG. 7). When the leading end of one of the successive fly strips 1 arrives at the wedge-shaped plow 21, the leading edge **21*a* enters a relatively small gap 10 (FIGS. 2 and 17) between the other fastener stringer 3 and the second flap 9 of the one fly strip 1. With continued movement of the fly strips 1, the same second flap 9 is deflected or moved aside progressively, as it slides on the canted side surface 21*a* as shown in FIGS. 18 and 19, until the second flap 9 lies at a right angle with respect to the general plane of the fastener stringers 2,3 (FIGS. 3 and 4). The fly strip 1, with the deflected second flap 9, is then guided by the guide 22 to the turning point 15 where the direction of movement of the successive fly strips 1 is shifted to the second straight path 14 which leads to a peripheral apparatus such as an element-free gap forming apparatus (not shown). During this guiding, the second flap 9 is guided on opposite sides by the upright guide wall 22' and an upright auxiliary guide plate 23, as shown in FIG. 20**.

Then, a relatively large triangular space 16 is temporarily provided between the confronting ends **9*a*,9*b* of an adjacent pair of the successive second flaps 9,9 when the same confronting ends 9*a*,9*b* arrive at the turning point 15. This relatively large inter-flap space 16 allows the light from the light source 17*a* to pass through the space 16 to reach the photoelectric transducer element 17*b*. The photoelectric transducer element 17*b* produces a signal pulse, which indicates that the confronting ends 9*a*,9*b* of an adjacent pair of the second flaps 9,9, i.e. a trailing end of the preceding fly strip 1 and a leading end of the succeeding fly strip 1, have arrived at the turning point 15. Upon receipt of the signal pulse from the photoelectric transducer element 17*b*, the counter 18 starts to count the number of revolutions of the driven roller 19 until the next signal pulse fom the photoelectric transducer element 17***b* is issued, thereby measuring the length of the individual fly strip 1. The counter 18 produces an output signal for automatically controlling an intermittently operating peripheral apparatus, such as an element-free gap forming apparatus (not shown) to which the second straight path 14 leads, depending on the length of each individual fly strip 1.

Figure 22:
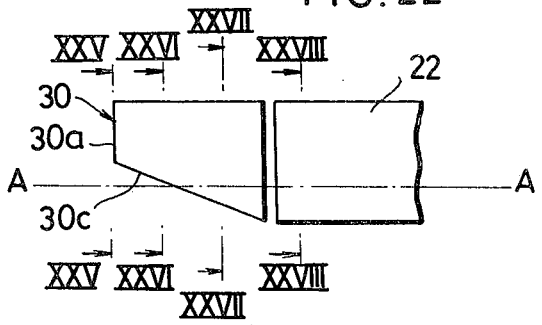
FIG. 22 is a fragmentary plan view of a modified deflector.
Figure 23:
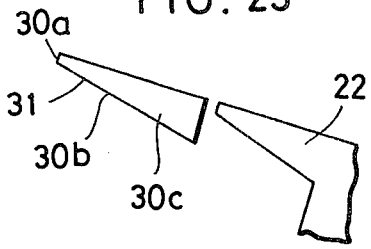
FIG. 23 is a fragmentary side elevational view corresponding to FIG. 23.
Figure 24:
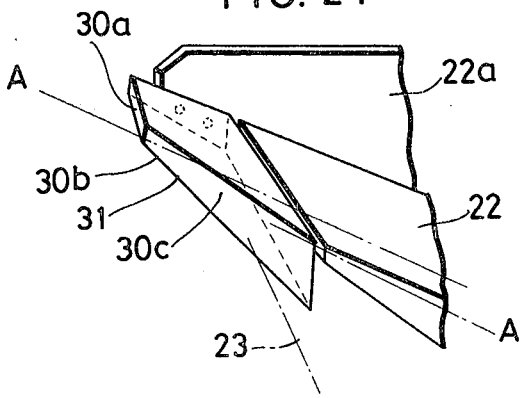
FIG. 24 is a fragmentary perspective view corresponding to FIG. 23.
Figure 25:
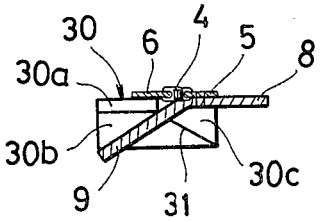
FIGS. 25, 26, 27 and 28 are transverse cross-sectional views similar to FIGS. 17, 18, 19 and 20, respectively, but taken along lines XXV—XXV, XXVI—XXVI, XXVII—XXVII and XXVIII—XXVIII, respectively, of FIG. 22.
Figure 26:
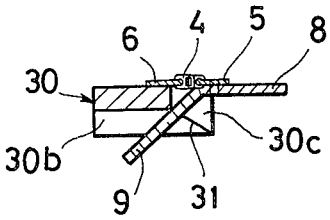
Figure 27:
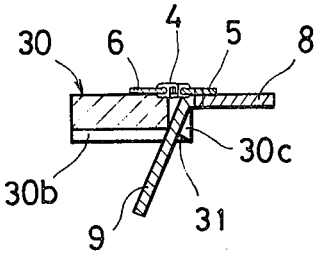
Figure 28:
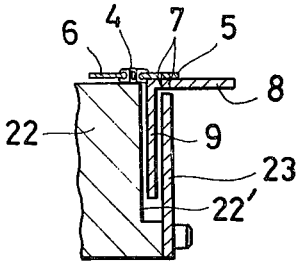

FIGS. 22, 23 and 24 show a modified wedge-shaped plow 30 having a transverse leading edge 30*a*, a sloping bottoms surface 30*b*, and an upright side surface 30*c* extending obliquely with respect to the first straight path 13. The leading edge 30*a* is thin enough to enter between the tape 3 of the other fastener stringer 6 and the individual second flap 9 as the leading end 9*b* of the latter arrives at the plow 30, as shown in FIG. 25. With continued movement of the fly strips 1, the individual second flap 9 is moved aside progressively, as it slides on a ridge 31 defined by the sloping bottom surface 30*b* and the upright side surface 30*c*, as shown in FIGS. 26 and 27. As a result, the second flap 9 lies at a right angle to the general plane of the fastener stringers 2,3. The fly strip 1, with the second flap 9 in vertical or deflected position, are then guided by the upright guide wall 22' and the upright auxiliary guide plate 23, as shown in FIG. 28.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A method of detecting ends of successive fly strips connected end to end in substantially abutting relation by a pair of continuous slide fastener stringers, the fly strips being attached to a tape of one of the fastener stringers by at least one line of stitching dividing each fly strip into a first and a second flap, said method comprising the steps of:

(a) feeding the successive fly strips along a first straight path, with the first flaps superimposed on the tape of the one fastener stringer and with the second flaps superimposed on the other fastener stringer;

(b) deflecting the successive second flaps to such an extent that each second flap lies at a right angle to the general plane of the fastener stringers;

(c) shifting the direction of movement of the successive fly strips at a turning point to a second straight path inclined with respect to said first straight path so as to provide temporarily a triangular space between onfronting ends of an adjacent pair of the deflected second flaps when said confronting ends arrive at said turning point; and (d) sensing the presence of said successive triangular spaces.

2. An apparatus for detecting ends of successive fly strips connected end to end in substantially abutting relation by a pair of continuous slide fastener stringers, the fly strips being attached to a tape of one of the fastener stringers by at least one line of stitching dividing each fly strip into a first flap superimposed on the tape of the one fastener stringer and a second flap superimposed on the other fastener stringer, said apparatus comprising:

(a) means for feeding the successive fly strip along a combined path including a pair of first and second straight paths joined at a turning point;

(b) a deflector disposed on said first straight path upstream of said turning point for deflecting the successive second flaps, as they pass said deflector, to such an extent that the individual second flap lies at a right angle to the general plane of the fastener stringers;

(c) said first and second straight paths being inclined with respect to one another for shifting the direction of movement of the successive fly strips at said turning point so as to provide temporarily a triangular space between confronting ends of an adjacent pair of the deflected second flaps when said confronting ends arrive at said turning point; and (d) a detector, disposed in such a position that the triangular spaces between the successive second flaps are sensed by said detector successively as the successive fly strips are fed, for producing a signal pulse every time each triangular space is sensed by said detector, said signal pulse being indicative of the arrival of confronting ends of an adjacent pair of the fly strips.

3. An apparatus according to claim 2, said deflector comprising a wedge-shaped plow having a transverse leading edge, a sloping bottom surface, and a side surface extending obliquely with respect to said first straight path, said leading edge being thin enough to readily enter between the other fastener stringer and the individual second flap when a leading end of the corresponding fly strip arrives at said plow.

4. An apparatus according to claim 3, said side surface of said wedge-shaped plow being upright.

5. An apparatus according to claim 3, said side surface of said wedge-shaped plow being canted.

* * * * *